US010905270B2

(12) United States Patent
Gelder et al.

(10) Patent No.: US 10,905,270 B2
(45) Date of Patent: Feb. 2, 2021

(54) INFANT DRESSING AID

(71) Applicants: Adam Gelder, Oak Lawn, IL (US); Gina Fron, Oak Lawn, IL (US)

(72) Inventors: Adam Gelder, Oak Lawn, IL (US); Gina Fron, Oak Lawn, IL (US)

( * ) Notice: Subject to any disclaimer, the term of this patent is extended or adjusted under 35 U.S.C. 154(b) by 148 days.

(21) Appl. No.: 16/269,879

(22) Filed: Feb. 7, 2019

(65) Prior Publication Data

US 2019/0246826 A1 Aug. 15, 2019

Related U.S. Application Data

(60) Provisional application No. 62/628,993, filed on Feb. 10, 2018.

(51) Int. Cl.
*A47G 25/90* (2006.01)

(52) U.S. Cl.
CPC ..... *A47G 25/90* (2013.01)

(58) Field of Classification Search
CPC ..... A47G 25/90; A47G 25/901–908; A41B 11/10; A41B 13/04; A41D 27/12; A41D 13/08; A41D 13/088; A41D 17/00; A41F 9/00; A41F 11/10; A41F 11/16; A41F 13/00; A41F 17/00; A41F 17/02; A41F 17/04
USPC ..... D2/280, 641
See application file for complete search history.

(56) References Cited

U.S. PATENT DOCUMENTS

| | | | | |
|---|---|---|---|---|
| 815,998 | A * | 3/1906 | Wolff | A41F 13/00 |
| 924,545 | A * | 6/1909 | Emmert | A41D 13/08 2/16 |
| 1,636,107 | A | 7/1927 | Namiot | |
| 1,808,049 | A * | 6/1931 | Lyden | A41D 13/088 2/170 |
| 2,042,567 | A * | 6/1936 | Trieschmann | A41B 7/12 2/60 |
| 2,525,756 | A | 10/1950 | Aines | |
| 2,596,112 | A | 5/1952 | Aines | |
| 2,605,471 | A | 8/1952 | Kephart | |
| 2,720,656 | A | 10/1955 | Allan | |
| 2,869,138 | A | 1/1959 | Hankoff | |
| 3,137,863 | A | 6/1964 | Dimpfl | |
| 3,411,160 | A | 11/1968 | Le et al. | |
| 4,984,299 | A * | 1/1991 | Halldorsdottir | A41D 13/08 15/227 |
| 6,000,408 | A | 12/1999 | Maturaporn | |
| 6,158,057 | A | 12/2000 | Neumann | |
| 6,393,619 | B1 | 5/2002 | Bardes | |

(Continued)

*Primary Examiner* — Ismael Izaguirre
(74) *Attorney, Agent, or Firm* — RMCK Law Group PLC

(57) ABSTRACT

A dressing aid device includes an inner support ring having an outer diameter surface and an inner diameter surface defining an aperture configured to receive an individual's limb, and an outer support ring coupled to the inner support ring and extending radially outward therefrom. The outer support ring includes an inner diameter surface, an outer diameter surface, and a stop surface extending between the outer support ring inner and outer diameter surfaces. When the inner support ring is placed around the individual's limb, the stop surface is oriented to face toward and selectively engage a garment inserted over the individual's limb to facilitate preventing the individual's limb from retracting back out of the garment.

19 Claims, 4 Drawing Sheets

(56) References Cited

U.S. PATENT DOCUMENTS

| | | | | |
|---|---|---|---|---|
| 6,968,572 | B1 * | 11/2005 | Johnson | A41D 13/08 2/16 |
| 8,196,266 | B2 | 6/2012 | Stratton-Metzger | |
| 10,448,688 | B2 * | 10/2019 | Cassell | A41F 13/00 |
| 2006/0206991 | A1 | 9/2006 | Barnes | |
| 2007/0083971 | A1 | 4/2007 | Scully | |
| 2009/0032044 | A1 | 2/2009 | Grimm | |
| 2013/0212781 | A1 | 8/2013 | Deane | |
| 2013/0239296 | A1 * | 9/2013 | Cole | A41D 27/08 2/244 |

* cited by examiner

INFANT DRESSING AID

CROSS-REFERENCE TO RELATED APPLICATIONS

This application claims the benefit of U.S. Provisional Patent Application No. 62/628,993, filed on Feb. 10, 2018, the contents of which are incorporated herein in their entirety by reference thereto.

FIELD

The present application relates generally to dressing aids and, more particularly, to a dressing aid to maintain clothing on an infant during dressing.

BACKGROUND

Dressing oneself or another person, particularly a child, can be a challenging process. For example, after placing a portion of a garment onto an individual's leg or arm, subsequent movement of that leg or arm can result in the clothing falling off the individual's leg or arm. One common and frustrating example occurs when a parent manages to secure one pant leg around their baby's ankle, but as they struggle to encircle the other leg with the second pant leg, the child pulls his leg from the initially placed pant leg.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one example aspect of the disclosure, a dressing aid device is provided. The dressing aid device includes an inner support ring having an outer diameter surface and an inner diameter surface defining an aperture configured to receive an individual's limb, and an outer support ring coupled to the inner support ring and extending radially outward therefrom. The outer support ring includes an inner diameter surface, an outer diameter surface, and a stop surface extending between the outer support ring inner and outer diameter surfaces. When the inner support ring is placed around the individual's limb, the stop surface is oriented to face toward and selectively engage a garment inserted over the individual's limb to facilitate preventing the individual's limb from retracting back out of the garment.

In addition to the foregoing, the described dressing aid device may include one or more of the following: wherein the outer support ring extends radially outward from the inner support ring in a direction substantially perpendicular to the inner support ring outer diameter surface; wherein the outer support ring defines an overall outer diameter configured to be larger than an opening of the garment such that the opening cannot fit over the overall outer diameter to further facilitate preventing the individual's limb from retracting back out of the garment; where the inner support ring has a width that is greater than a thickness of the outer support ring; and wherein at least one of the inner and outer support rings is fabricated from an elastomeric material.

In addition to the foregoing, the described dressing aid device may include one or more of the following: wherein the inner and outer support rings are fabricated from a medical grade silicone material; wherein the outer support ring includes a plurality of circumferentially spaced gripping tabs; wherein each gripping tab of the plurality of circumferentially spaced gripping tabs includes an outer wall, an inner wall, and a pair of radially extending side walls; wherein the inner wall is coupled to the inner support ring and defines at least a portion of the outer support ring inner diameter surface; wherein the outer wall is rounded; wherein the rounded outer wall has a substantially constant radius extending from a center point of the gripping tab; and wherein each radially extending side wall is coupled to a radially extending side wall of an adjacent gripping tab.

In addition to the foregoing, the described dressing aid device may include one or more of the following: wherein the plurality of gripping tabs comprises eight circumferentially spaced gripping tabs; wherein at least one gripping tab of the plurality of gripping tabs includes an outer surface extending between the outer support ring inner and outer diameter surfaces that at least partially defines the stop surface, wherein the gripping tab outer surface includes a raised gripping texture configured to enhance the gripping capability of the gripping tab; wherein the raised gripping texture includes a continuous inner edge and a continuous outer edge; and wherein the continuous outer edge is generally sinusoidal shaped, and the continuous inner edge is generally heart shaped.

In accordance with another example aspect of the disclosure, a dressing aid device is provided. The dressing aid device includes an inner support ring having an outer diameter surface and an inner diameter surface defining an aperture configured to receive an individual's limb, and an outer support ring coupled to the inner support ring and extending radially outward therefrom. The outer support ring includes an inner diameter surface, an outer diameter surface, and a stop surface extending between the outer support ring inner and outer diameter surfaces. The outer support ring defines an overall outer diameter configured to be larger than an opening of a garment such that when the inner support ring is placed around the individual's limb, the stop surface is oriented to face toward and selectively engage the garment when the garment is inserted over the individual's limb such that the opening cannot fit over the overall outer diameter to thereby facilitate preventing the individual's limb from retracting back out of the garment. The outer support ring extends radially outward from the inner support ring in a direction substantially perpendicular to the inner support ring outer diameter surface. The inner and outer support rings are fabricated from an elastomeric material. The outer support ring includes a plurality of circumferentially spaced gripping tabs, and each gripping tab of the plurality of circumferentially spaced gripping tabs includes an outer wall, an inner wall, and a pair of radially extending side walls.

In addition to the foregoing, the described dressing aid device may include one or more of the following: wherein at least one gripping tab of the plurality of gripping tabs includes an outer surface extending between the outer support ring inner and outer diameter surfaces that at least partially defines the stop surface, and wherein the gripping tab outer surface includes a raised gripping texture configured to enhance the gripping capability of the gripping tab; wherein the aperture has a diameter of between approximately 1.0 inches and approximately 2.0 inches, and wherein the overall diameter is between approximately 3.0 inches and approximately 4.0 inches; and wherein each gripping tab of the plurality of gripping tabs includes: a first thickness at the outer support ring inner diameter surface between approximately zero inches and approximately 0.5 inches, a second thickness at the outer support ring outer diameter surface between approximately 0.25 inches and approximately 1.0 inches, and a third thickness at a center point of the gripping tab, the third thickness between approximately 0.25 inches and approximately 0.75 inches.

Further areas of applicability of the teachings of the present application will become apparent from the detailed description, claims and the drawings. It should be understood that the detailed description, including disclosed embodiments and drawings referenced therein, are merely exemplary in nature intended for purposes of illustration only and are not intended to limit the scope of the present application, its application or uses. Thus, variations that do not depart from the gist of the present application are intended to be within the scope of the present application.

BRIEF DESCRIPTION OF DRAWINGS

FIG. 3 is rear view of the example dressing aid device shown in

FIG. 1;

DESCRIPTION

The present application is generally directed to a dressing aid device configured to encircle a distal portion of a person's limbs to facilitate preventing the limb from sliding out of a garment or clothing. In one example, once the garment is drawn over the limb, the dressing aid device is secured around the wrist or ankle below the end (e.g., cuff) of the garment. The dressing aid device includes an inner annular band defining an inner opening to receive the limb, and material extends outwardly from the inner annular band to establish a diameter that is larger than the garment's opening. As such, once in place, the dressing aid device prevents the garment from being removed from the limb without removal of the dressing aid from the wrist or ankle.

In one example, this allows a parent to put one leg of a child through a pair of pants, and then set the dressing aid device around the child's ankle, thereby allowing time for the parent to put the child's other leg through the remaining pant leg. The pants may then be pulled up to and around the child's waist. Once the pants are in place, the dressing aid device is removed from the child's leg. Similarly, before the pants are again lowered, for example, to change the child's diaper, one dressing aid device may be placed on each ankle to retain the pants on the child until the diaper is changed. Although described as being used for an infant or child, it will be appreciated that the dressing aid device described herein may be utilized to aid dressing adults, animals, objects (e.g., mannequins or dolls), or the like.

Figure 1:
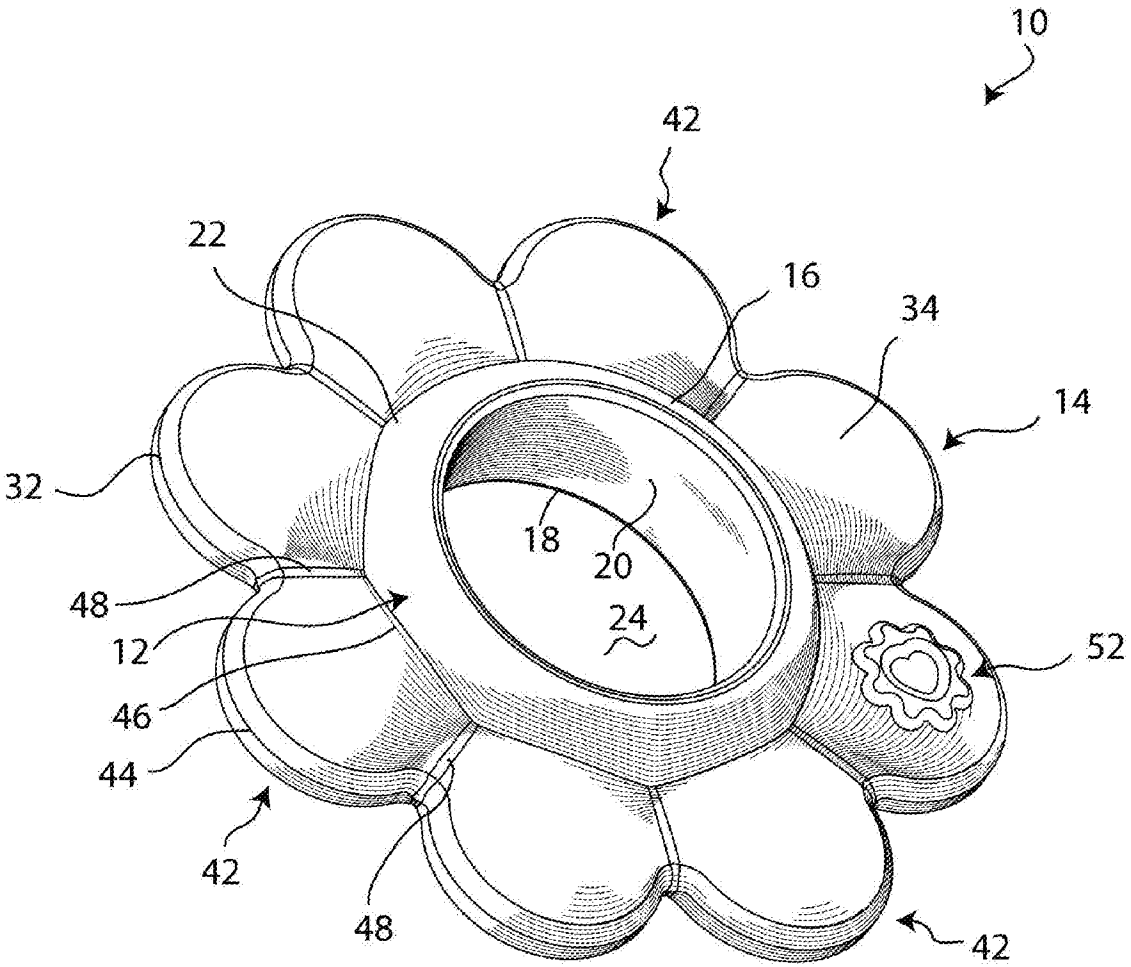
FIG. 1 is a perspective view of an example dressing aid device constructed in accordance to the principles of the present disclosure.
Figure 3:
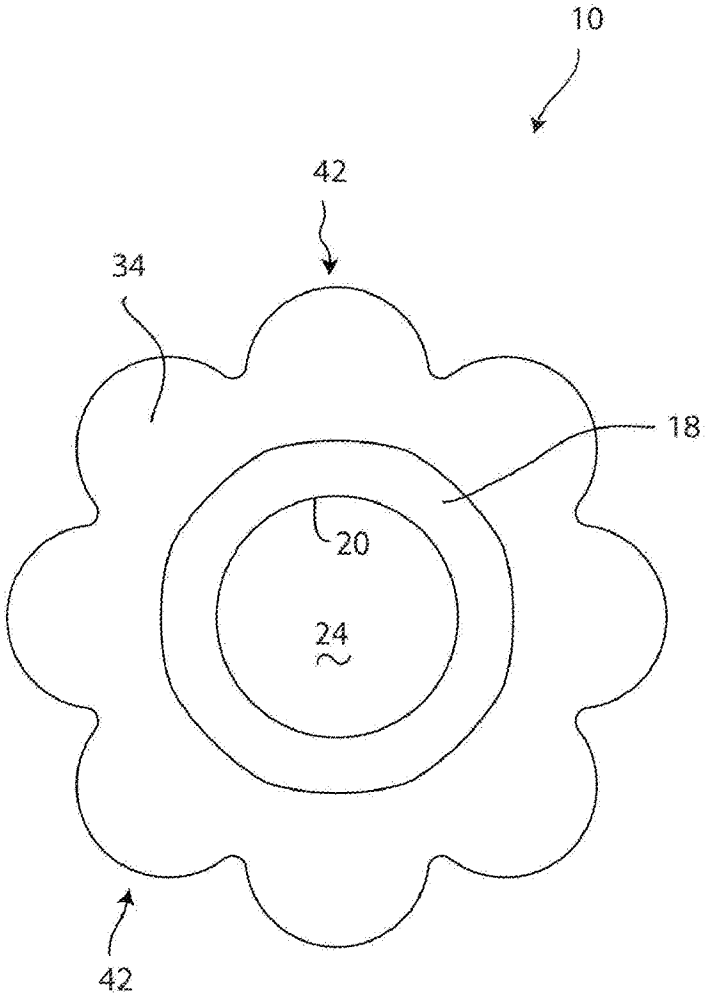

Referring to FIG. 1, an example dressing aid device is generally shown and indicated at reference numeral 10. In the example embodiment, the dressing aid device 10 generally includes an inner support ring 12 and an outer support surface or ring 14 extending therefrom. In one embodiment, inner and outer support rings 12, 14 are formed as a single, unitary object, for example, via injection molding. Alternatively, inner and outer support rings 12, 14 are formed as distinct components and subsequently coupled together.

Moreover, it will be appreciated that inner and outer support rings 12, 14 may be fabricated from similar materials or different materials depending on the desired performance and/or function. In the example embodiment, dressing aid device 10 is fabricated from an expandable or stretchable material such as an elastomer (e.g., rubber), medical grade silicone, or the like. Accordingly, as described herein in more detail, the dressing aid device 10 is configured to be stretched or expanded by a force to fit around a limb, and when the force is removed, the dressing aid device 10 substantially returns to its original, unstressed configuration.

Figure 4:
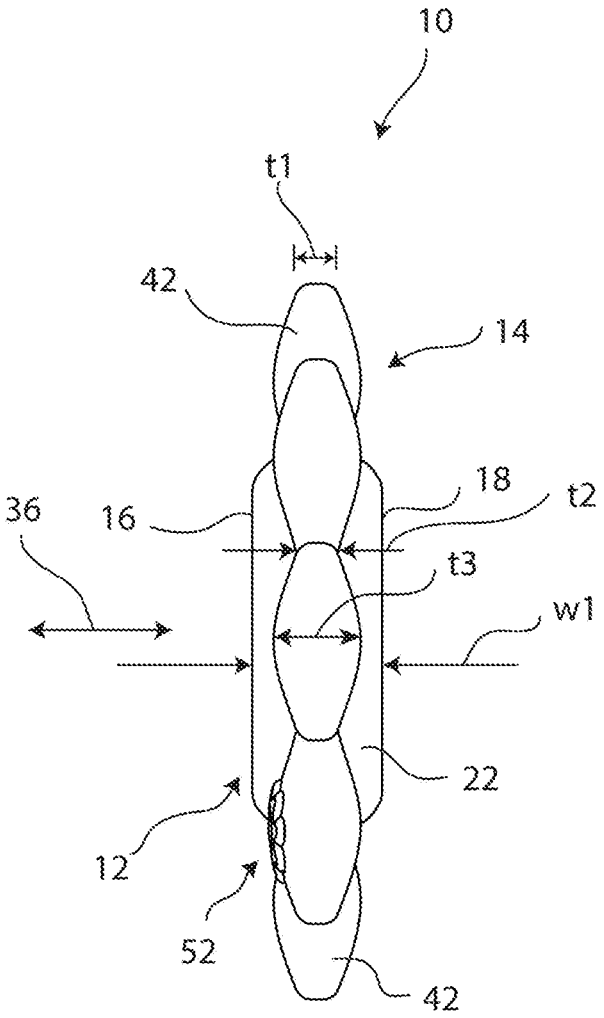
FIG. 4 is a side view of the example dressing aid device shown in FIG. 1.
Figure 5:
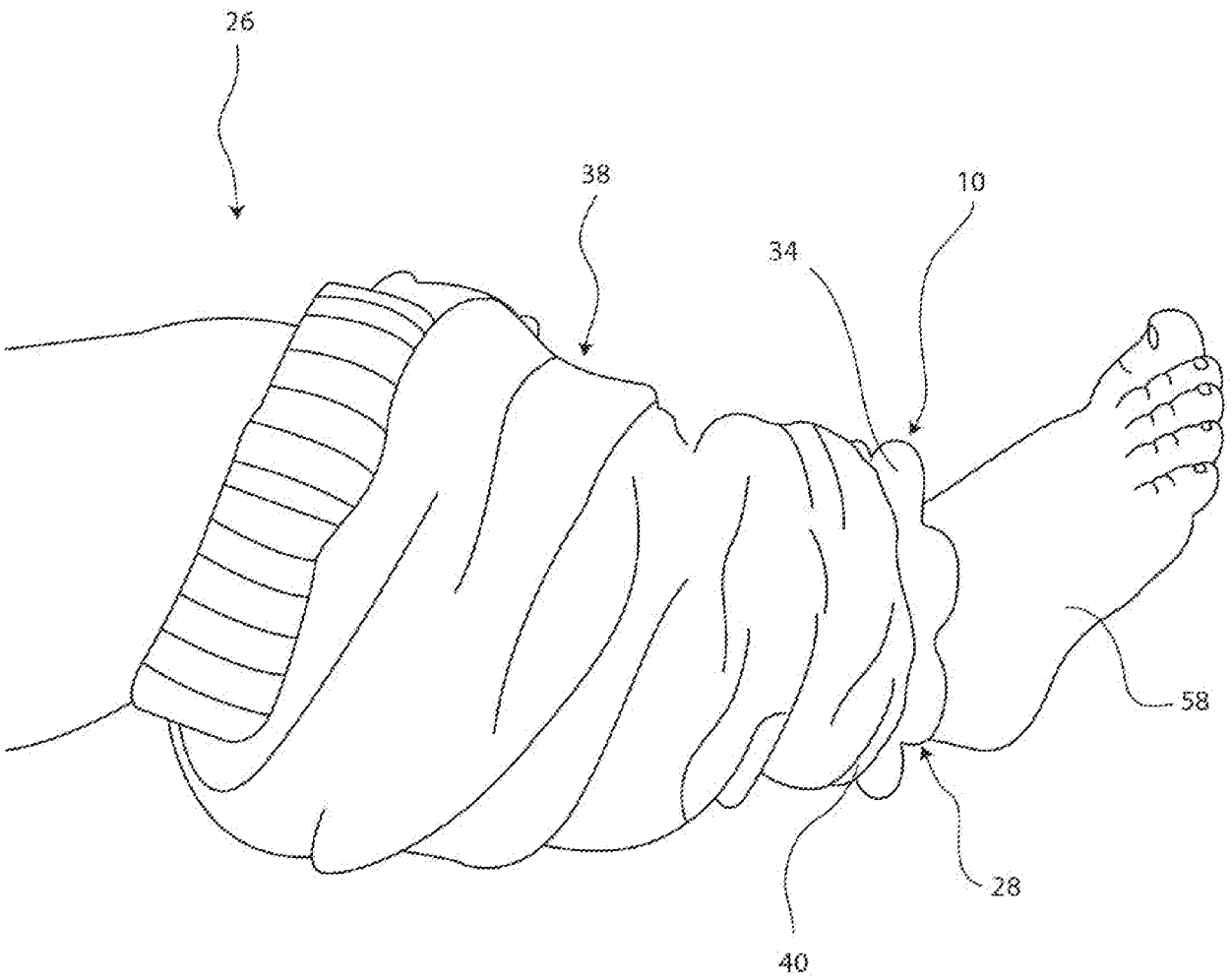
FIG. 5 is a perspective view of the example dressing aid device of FIG. 1 placed on a child's ankle to facilitate preventing removal of the child's leg from a pant leg.

With additional reference to FIGS. 1-4, in the example embodiment, the inner support ring 12 may be generally annular and include a first end 16, an opposite second end 18, an inner diameter surface 20, and an outer diameter surface 22. As shown in FIG. 4, inner support ring 12 has a width 'w1' defined between the first end 16 and the second end 18. The inner diameter surface 20 defines an aperture 24 configured to fit around a limb 26 or other object. For example, as shown in FIG. 5, the aperture 24 is configured to fit around an ankle 28 of a child's limb 26, as described herein in more detail. While aperture 24 is illustrated as circular or substantially circular, it will be appreciated that aperture 24 can have any suitable shape that enables dressing aid device 10 to function as described herein. For example, aperture 24 may have a generally oval shape.

Figure 2:
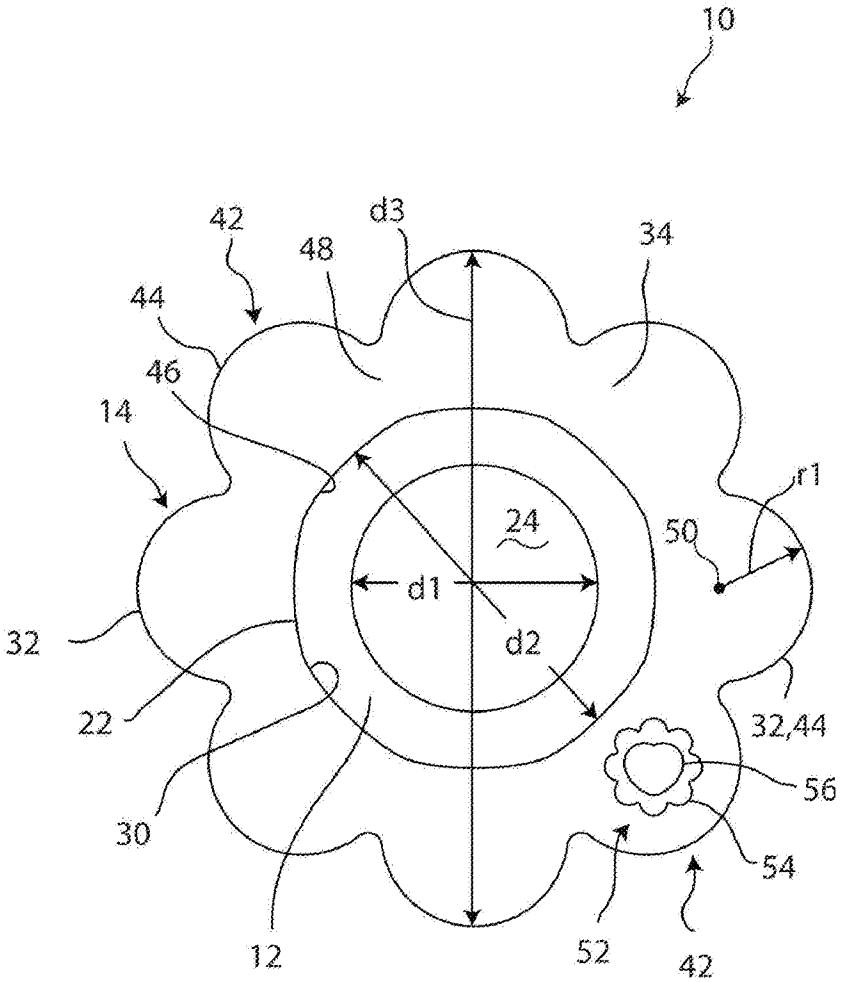
FIG. 2 is a front view of the example dressing aid device shown in FIG. 1.

In the example shown in FIG. 2, the inner support ring 12 has an inner diameter 'd1' defined by the inner diameter surface 20 and aperture 24, and an outer diameter 'd2' defined by the outer diameter surface 22. In the illustrated example, the outer diameter surface 22 can be a rounded or partially rounded surface extending between the first end 16 and the second end 18 (see FIGS. 1 and 4).

With continued reference to FIGS. 1-4, the outer support ring 14 will be described in more detail. In the example embodiment, outer support ring 14 generally includes an inner diameter surface 30, an outer diameter surface 32, and a garment stop surface 34. The inner diameter surface 30 is coupled to the inner support ring outer diameter surface 22 such that outer support ring 14 extends radially outward from the inner support ring 12. In one example, the outer support ring 14 extends in a direction that is perpendicular to or substantially perpendicular to a direction of longitudinal extension 36 of the inner support ring 12 (e.g., in a direction of extension of a center of the aperture 24), the inner diameter surface 20, and/or the outer diameter surface 22. In this way, outer support ring 14 is configured to present the stop surface 34 in an orientation generally facing toward a garment 38 to be retained on the limb 26 (see FIG. 5).

In the example embodiment, the stop surface 34 is defined between the inner and outer diameter surfaces 30, 32 and is configured to engage or catch at least a portion of the garment 38, such as a cuff 40, to facilitate maintaining the garment on the limb 26 by preventing the garment 38 from passing over the dressing aid device 10. More specifically, the outer support ring 14 establishes an overall outer diameter 'd3' (FIG. 2) of the dressing aid device 10 that is larger than a diameter or opening of the of the garment (e.g., the cuff 40). As such, since the smaller diameter cuff 40 cannot pass over the larger overall outer diameter 'd3,' the dressing aid device 10 facilitates retaining the garment 38 on the wearer's arm or leg by preventing the limb 26 from retracting back into and out of the garment 38.

In the illustrated example, outer support ring 14 comprises a plurality of circumferentially spaced gripping tabs 42. In addition to providing the stop surface 34, the gripping tabs 42 are configured to provide a structure for the user to grip and manipulate the dressing aid device 10. For example, the user can utilize gripping tabs 42 to stretch the device during insertion or removal of the device 10 onto or from the limb 26. Each gripping tab 42 generally includes an outer wall 44, an inner wall 46, and radially extending side walls 48 (FIG. 1). The outer wall 44 generally defines at least a portion of the outer diameter surface 32, the inner wall 46 generally defines at least a portion of the inner diameter surface 30, and the radially extending side walls 48 are shared with or extend along adjacent gripping tab side walls 48.

As shown in FIG. 4, in the example embodiment, each gripping tab 42 can have a thickness 't1' at the inner diameter surface 30, and a thickness 't2' at the outer diameter surface 32. In one example, thicknesses 't1' and 't2' are equal or substantially equal to each other. The stop surface 34 of each side of the gripping tab 42 may be rounded to extend generally in the direction 36 such that the gripping tab defines a thickness 't3' at a center point 50 on or of the gripping tab 42. As such, in one example, the rounded outer wall 44 is formed with a constant radius 'r1' extending from the center point 50 (see FIG. 2).

As shown in FIGS. 1, 2, and 4, in one example, one or more gripping tab stop surfaces 34 can include a raised gripping texture 52 configured to enhance the gripping capability of the surface 34 for the user. In the illustrated example, the raised gripping texture 52 includes a generally continuous circumferential sinusoidal outer edge 54 with a generally continuous heart shaped inner edge 56 (see FIG. 2). In the example embodiment, the unique shape of the edges 54, 56 is configured to provide a multiangle edge to improve or maximize the gripping surface area of the raised gripping texture 52. However, it will be appreciated that raised gripping texture 52 can have various other shapes, patterns, textures, etc. such as, for example, a plurality of raised dots, a plurality of raised wavy lines, an enlarged raised ring, or the like.

Although illustrated as having eight generally rounded gripping tabs 42, it will be appreciated that outer support ring 14 can have one or more gripping tabs of various shapes and sizes. For example, outer support ring 14 can have six or ten gripping tabs, or the gripping tab may be a continuous or discontinuous circular gripping tab with a constant or substantially constant radius. In one example, outer support ring 14 may be a continuous or substantially continuous disc.

With reference now to FIG. 5, one example use of the dressing aid device 10 is described. In the described example, the clothing or garment 38 is a pair of pants, and one pant leg is inserted over the child's limb 26 such that the child's foot 58 and ankle 28 extend out of the pant leg cuff 40. The user provides the dressing aid device 10 and provides a force to expand or enlarge the aperture 24, for example by gripping and pulling the inner support ring 12 and/or one or more gripping tabs 42. The foot 58 is then inserted through the enlarged aperture 24 of the dressing aid device 10.

Once the device 10 is positioned over or proximate the ankle 28, the force is released and, due to the elastomeric qualities of the device 10 material, the inner support ring 12 contracts and secures around the child's limb 26 below the pant leg cuff 40. In this position, the dressing aid device 10 presents the stop surface 34 in an orientation that generally faces toward the garment 38 and cuff 40. Because the outer support ring 14 provides device 10 with an overall outer diameter 'd3' that is larger than the diameter or size of the opening of cuff 40, the child is prevented from pulling her limb 26 back into and out of the pant leg. As such, the user can direct his or her attention toward placing the other pant leg over the child's other leg (not shown) without worry of limb 26 slipping out of or otherwise being pulled from the first pant leg.

In one example, width 'w1' is between approximately 0.25 inches and approximately 1.0 inches, or between 0.25 inches and 1.0 inches. In another example, width 'w1' is between approximately 0.5 inches and approximately ⅔ inches, or between 0.5 inches and ⅔ inches. In yet another example, width 'w1' is approximately 0.625 inches or 0.625 inches.

In one example, diameter 'd1' is between approximately 1.0 inches and approximately 2.0 inches, or between 1.0 inches and 2.0 inches. In another example, diameter 'd1' is between approximately 1.25 inches and approximately 1.5 inches, or between 1.25 inches and 1.5 inches. In yet another example, diameter 'd1' is approximately 1.375 inches or 1.375 inches.

In one example, diameter 'd2' is between approximately 1.25 inches and approximately 2.25 inches, or between 1.25 inches and 2.25 inches. In another example, diameter 'd2' is between approximately 1.5 inches and approximately 1.75 inches, or between 1.5 inches and 1.75 inches. In yet another example, diameter 'd2' is approximately 1.625 inches or 1.625 inches.

In one example, diameter 'd3' is between approximately 3.0 inches and approximately 4.0 inches, or between 3.0 inches and 4.0 inches. In another example, diameter 'd3' is between approximately 3.25 inches and approximately 3.75 inches, or between 3.25 inches and 3.75 inches. In yet another example, diameter 'd3' is approximately 3.5 inches or 3.5 inches.

In one example, thickness 't1' is between approximately zero inches and approximately 0.5 inches, or between zero inches and 0.5 inches. In another example, thickness 't1' is between approximately 0.0625 inches and approximately 0.1875 inches, or between 0.0625 inches and 0.1875 inches. In yet another example, thickness 't1' is approximately 0.125 inches or 0.125 inches.

In one example, thickness 't2' is between approximately 0.25 inches and approximately 1.0 inches, or between 0.25 inches and 1.0 inches. In another example, thickness 't2' is between approximately 0.5 inches and approximately ⅔ inches, or between 0.5 inches and ⅔ inches. In yet another example, thickness 't2' is approximately 0.625 inches or 0.625 inches.

In one example, thickness 't3' is between approximately 0.25 inches and approximately 0.75 inches, or between 0.25 inches and 0.75 inches. In another example, thickness 't3' is between approximately 0.3125 inches and approximately 0.5625 inches, or between 0.3125 inches and 0.5625 inches. In yet another example, thickness 't3' is approximately 0.4375 inches or 0.4375 inches.

Described herein are systems and methods for retaining clothing on an individual's limb. The system includes a dressing aid device having an inner support ring and an outer support ring. The inner support ring is configured to be enlarged such that a hand or foot can be inserted through the ring, which is subsequently secured around the limb. The outer support ring presents a surface that is larger than an opening of the clothing to facilitate preventing the clothing from slipping over the dressing aid device and the individual's limb from coming out of the clothing. The described dressing aid device is particularly useful for assisting a person in dressing or diaper changing an infant.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A dressing aid device comprising:

an inner support ring having an outer diameter surface and an inner diameter surface defining an aperture configured to receive an individual's limb; and an outer support ring coupled to the inner support ring and extending radially outward therefrom, the outer support ring including an inner diameter surface, an outer diameter surface, and a stop surface extending between the outer support ring inner and outer diameter surfaces, wherein when the inner support ring is placed around the individual's limb, the stop surface is oriented to face toward and selectively engage a garment inserted over the individual's limb to facilitate preventing the individual's limb from retracting back out of the garment, wherein the outer support ring includes a plurality of circumferentially spaced gripping tabs.

2. The dressing aid device of claim 1, wherein the outer support ring extends radially outward from the inner support ring in a direction substantially perpendicular to the inner support ring outer diameter surface.

3. The dressing aid device of claim 1, wherein the outer support ring defines an overall outer diameter configured to be larger than an opening of the garment such that the opening cannot fit over the overall outer diameter to further facilitate preventing the individual's limb from retracting back out of the garment.

4. The dressing aid device of claim 1, wherein the inner support ring has a width that is greater than a thickness of the outer support ring.

5. The dressing aid device of claim 1, wherein at least one of the inner and outer support rings is fabricated from an elastomeric material.

6. The dressing aid device of claim 1, wherein the inner and outer support rings are fabricated from a medical grade silicone material.

7. The dressing aid device of claim 1, wherein each gripping tab of the plurality of circumferentially spaced gripping tabs includes an outer wall, an inner wall, and a pair of radially extending side walls.

8. The dressing aid device of claim 7, wherein the inner wall is coupled to the inner support ring and defines at least a portion of the outer support ring inner diameter surface.

9. The dressing aid device of claim 7, wherein the outer wall is rounded.

10. The dressing aid device of claim 9, wherein the rounded outer wall has a substantially constant radius extending from a center point of the gripping tab.

11. The dressing aid device of claim 7, wherein each radially extending side wall is coupled to a radially extending side wall of an adjacent gripping tab.

12. The dressing aid device of claim 1, wherein the plurality of gripping tabs comprises eight circumferentially spaced gripping tabs.

13. The dressing aid device of claim 1, wherein at least one gripping tab of the plurality of gripping tabs includes an outer surface extending between the outer support ring inner and outer diameter surfaces that at least partially defines the stop surface, wherein the gripping tab outer surface includes a raised gripping texture configured to enhance the gripping capability of the gripping tab.

14. The dressing aid device of claim 13, wherein the raised gripping texture includes a continuous inner edge and a continuous outer edge.

15. The dressing aid device of claim 14, wherein the continuous outer edge is generally sinusoidal shaped, and the continuous inner edge is generally heart shaped.

16. A dressing aid device comprising:

an inner support ring having an outer diameter surface and an inner diameter surface defining an aperture configured to receive an individual's limb; and an outer support ring coupled to the inner support ring and extending radially outward therefrom, the outer support ring including an inner diameter surface, an outer diameter surface, and a stop surface extending between the outer support ring inner and outer diameter surfaces, wherein the outer support ring defines an overall outer diameter configured to be larger than an opening of a garment such that when the inner support ring is placed around the individual's limb, the stop surface is oriented to face toward and selectively engage the garment when the garment is inserted over the individual's limb such that the opening cannot fit over the overall outer diameter to thereby facilitate preventing the individual's limb from retracting back out of the garment, wherein the outer support ring extends radially outward from the inner support ring in a direction substantially perpendicular to the inner support ring outer diameter surface, wherein the inner and outer support rings are fabricated from an elastomeric material, and wherein the outer support ring includes a plurality of circumferentially spaced gripping tabs, each gripping tab of the plurality of circumferentially spaced gripping tabs including an outer wall, an inner wall, and a pair of radially extending side walls.

17. The dressing aid device of claim 16, wherein at least one gripping tab of the plurality of gripping tabs includes an outer surface extending between the outer support ring inner and outer diameter surfaces that at least partially defines the stop surface, and wherein the gripping tab outer surface includes a raised gripping texture configured to enhance the gripping capability of the gripping tab.

18. The dressing aid device of claim 16, wherein the aperture has a diameter of between approximately 1.0 inches and approximately 2.0 inches, and wherein the overall diameter is between approximately 3.0 inches and approximately 4.0 inches.

19. The dressing aid device of claim 18, wherein each gripping tab of the plurality of gripping tabs includes:

a first thickness at the outer support ring inner diameter surface between approximately zero inches and approximately 0.5 inches;

a second thickness at the outer support ring outer diameter surface between approximately 0.25 inches and approximately 1.0 inches; and a third thickness at a center point of the gripping tab, the third thickness between approximately 0.25 inches and approximately 0.75 inches.

* * * * *